US009879644B2

(12) United States Patent
Straub

(10) Patent No.: US 9,879,644 B2
(45) Date of Patent: Jan. 30, 2018

(54) FUEL INJECTOR WITH VARIABLE AREA PINTLE NOZZLE

(75) Inventor: Robert D. Straub, Lowell, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 1282 days.

(21) Appl. No.: 12/752,274

(22) Filed: Apr. 1, 2010

(65) Prior Publication Data

US 2011/0240770 A1 Oct. 6, 2011

(51) Int. Cl.

| | |
|---|---|
| ***F02M 61/00*** | (2006.01) |
| ***F02M 61/06*** | (2006.01) |
| ***F02M 61/16*** | (2006.01) |
| ***F02M 61/18*** | (2006.01) |

(52) U.S. Cl.

CPC ..... *F02M 61/06* (2013.01); *F02M 61/163* (2013.01); *F02M 61/1866* (2013.01)

(58) Field of Classification Search

CPC ... F02M 61/06; F02M 61/163; F02M 61/1866
USPC ..... 239/585.1–585.5, 533.2–533.12, 86, 239/88–92

See application file for complete search history.

(56) References Cited

U.S. PATENT DOCUMENTS

| | | | | |
|---|---|---|---|---|
| 1,952,816 | A * | 3/1934 | Mock | 239/488 |
| 2,017,028 | A * | 10/1935 | Heinrich et al. | 239/453 |
| 3,035,780 | A * | 5/1962 | Peras | 239/453 |
| 4,046,322 | A | 9/1977 | Knape et al. | |
| 4,213,568 | A * | 7/1980 | Hofmann | 239/533.4 |
| 4,528,951 | A * | 7/1985 | Yamada | 123/300 |
| 4,693,424 | A | 9/1987 | Sczomak | |
| 5,033,679 | A * | 7/1991 | Golev et al. | 239/533.3 |
| 5,671,890 | A | 9/1997 | Cooper et al. | |
| 5,823,443 | A | 10/1998 | Cooper et al. | |
| 7,308,169 | B2 * | 12/2007 | Chandrasekhar et al. | 385/27 |

FOREIGN PATENT DOCUMENTS

| | | | |
|---|---|---|---|
| CN | 1712697 | A | 12/2005 |

* cited by examiner

*Primary Examiner* — Viet Le
(74) *Attorney, Agent, or Firm* — Harness, Dickey & Pierce, P.L.C.

(57) ABSTRACT

A fuel injector may include a housing, a pintle nozzle assembly and an actuation assembly. The housing may define a longitudinal bore, a high pressure fuel duct in communication with the longitudinal bore and a valve seat including a valve seat surface and an aperture. The pintle nozzle assembly may include a stem and a pintle and may be at least partially disposed within the longitudinal bore and be variably displaceable between a first position and a second position. In the first position, the pintle nozzle assembly may abut the valve seat to seal the aperture. In the second position, the pintle nozzle assembly may be displaced from the valve seat to open the aperture. The actuation assembly may be coupled with the pintle nozzle assembly and operate to move the pintle nozzle assembly to a plurality of positions between the first position and the second position.

13 Claims, 5 Drawing Sheets

FIG 3
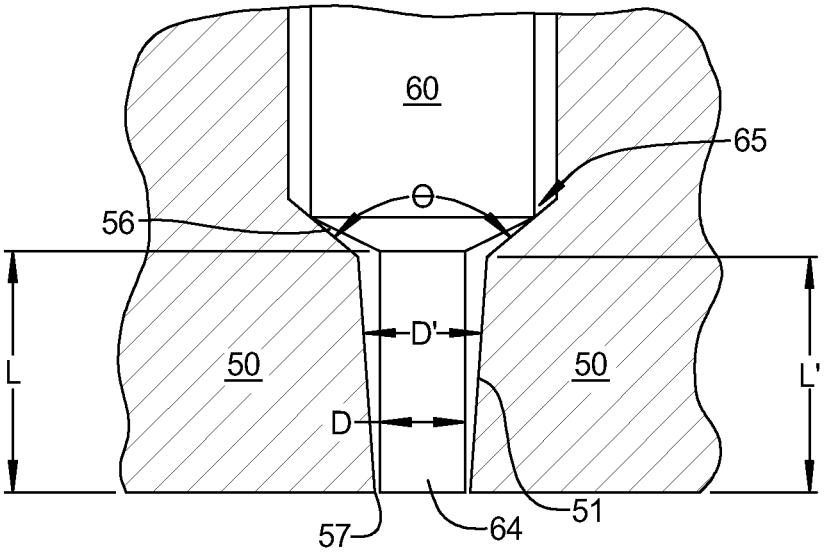
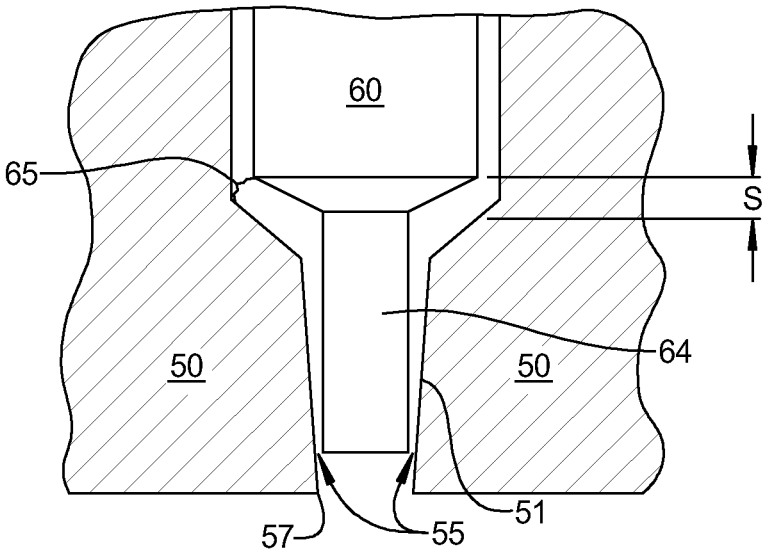
FIG 4

FIG 5
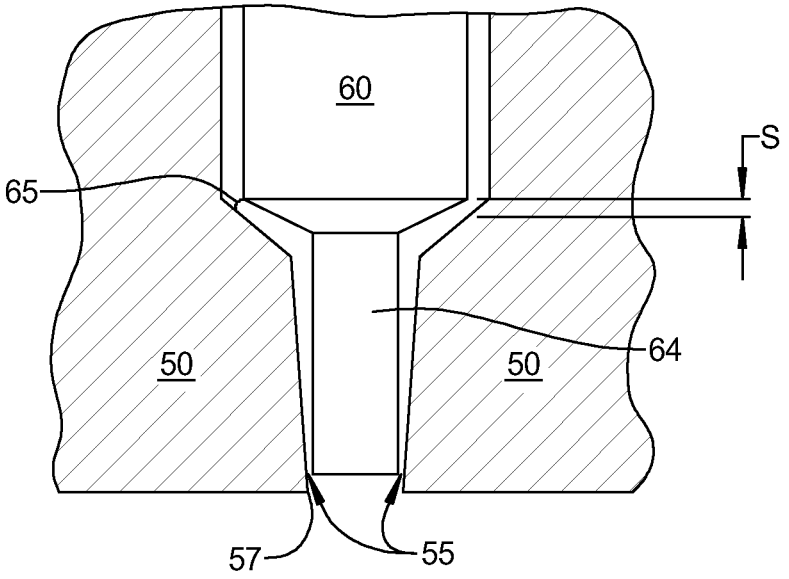
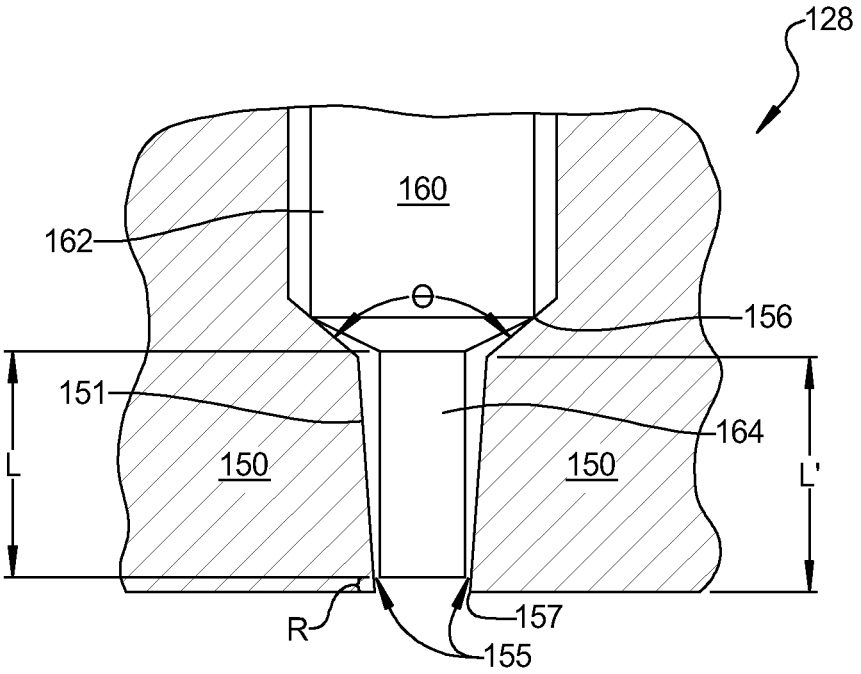
FIG 6

FUEL INJECTOR WITH VARIABLE AREA PINTLE NOZZLE

FIELD

The present disclosure relates to engine fuel systems, and more specifically to fuel injectors.

BACKGROUND

This section provides background information related to the present disclosure which is not necessarily prior art.

A fuel injector may include a pressurized fuel supply used to open and close an injection nozzle opening. The injector may include an actuation member and a valve mechanism to selective open and close a leakage path between low pressure and high pressure regions of the injector. Opening the leakage path may reduce a closing biasing force applied to an injection valve to open the injection nozzle opening. When the leakage path is closed, the injection valve may be displaced to close the injection nozzle opening. Thus, the injection nozzle opening is typically in one of two positions, i.e., a closed position or an open position, depending on whether pressurized fuel is being provided to the injection nozzle opening.

SUMMARY

This section provides a general summary of the disclosure, and is not a comprehensive disclosure of its full scope or all of its features.

A fuel injector may include a housing, a pintle nozzle assembly and an actuation assembly. The housing may define a longitudinal bore, a high pressure fuel duct in communication with the longitudinal bore and a valve seat including a valve seat surface and an aperture. The valve seat surface may be in communication with the high pressure fuel duct. The aperture may extend through the valve seat surface and be in communication with the longitudinal bore. The pintle nozzle assembly may include a stem and a pintle. The pintle nozzle assembly may be at least partially disposed within the longitudinal bore and be variably displaceable between a first position and a second position. In the first position, the pintle nozzle assembly may abut the valve seat to seal the aperture. In the second position, the pintle nozzle assembly may be displaced from the valve seat to open the aperture. The actuation assembly may be coupled with the pintle nozzle assembly. The actuation assembly may operate to move the pintle nozzle assembly to a plurality of positions between the first position and the second position.

An engine assembly may include an engine structure defining a cylinder and a fuel injector supported by the engine structure and in communication with the cylinder. The fuel injector may include a housing, a pintle nozzle assembly and an actuation assembly. The housing may define a longitudinal bore, a high pressure fuel duct in communication with the longitudinal bore and a valve seat including a valve seat surface and an aperture. The valve seat surface may be in communication with the high pressure fuel duct. The aperture may extend through the valve seat surface and be in communication with the longitudinal bore. The pintle nozzle assembly may include a stem and a pintle. The pintle nozzle assembly may be at least partially disposed within the longitudinal bore and be variably displaceable between a first position and a second position. In the first position, the pintle nozzle assembly may abut the valve seat to seal the aperture. In the second position, the pintle nozzle assembly may be displaced from the valve seat to open the aperture. The actuation assembly may be coupled with the pintle nozzle assembly. The actuation assembly may operate to move the pintle nozzle assembly to a plurality of positions between the first position and the second position.

Further areas of applicability will become apparent from the description provided herein. The description and specific examples in this summary are intended for purposes of illustration only and are not intended to limit the scope of the present disclosure.

BRIEF DESCRIPTION OF THE DRAWINGS

The drawings described herein are for illustrative purposes only and are not intended to limit the scope of the present disclosure in any way.

FIG. 3 is a partial section view of a fuel injector of the engine assembly of FIG. 1 in a first position;

FIG. 4 is a partial section view of the fuel injector of FIG. 3 in a second position;

FIG. 5 is a partial section view of the fuel injector of FIG. 3 in a third position;

FIG. 6 is a partial section view of an exemplary fuel injector that may be utilized with the engine assembly of FIG. 1;

Corresponding reference numerals indicate corresponding parts throughout the several views of the drawings.

DETAILED DESCRIPTION

Examples of the present disclosure will now be described more fully with reference to the accompanying drawings. The following description is merely exemplary in nature and is not intended to limit the present disclosure, application, or uses.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

When an element or layer is referred to as being "on," "engaged to," "connected to" or "coupled to" another element or layer, it may be directly on, engaged, connected or coupled to the other element or layer, or intervening elements or layers may be present. In contrast, when an element is referred to as being "directly on," "directly engaged to," "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Figure 1:
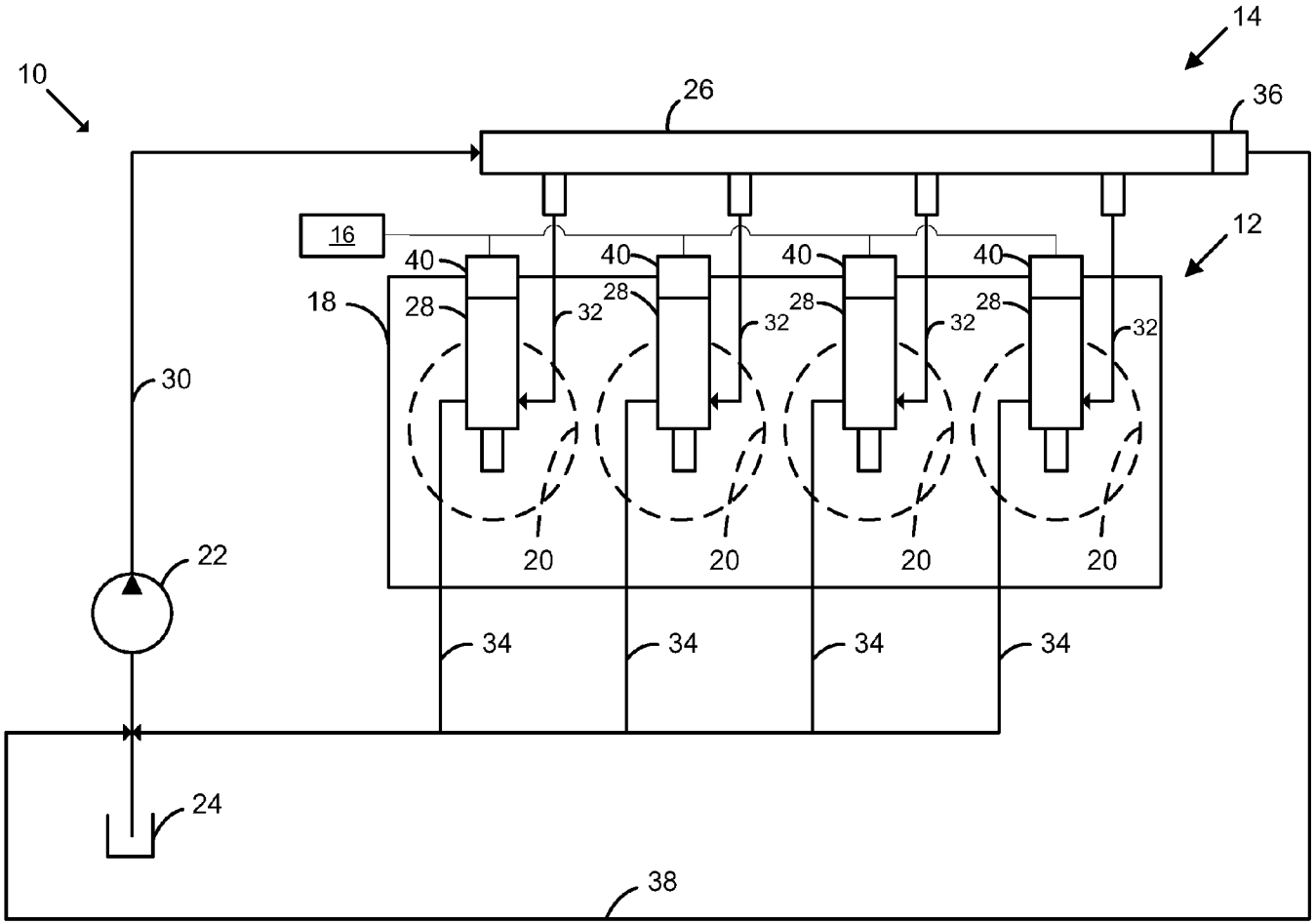
FIG. 1 is a schematic illustration of an engine assembly according to the present disclosure.
Figure 2:
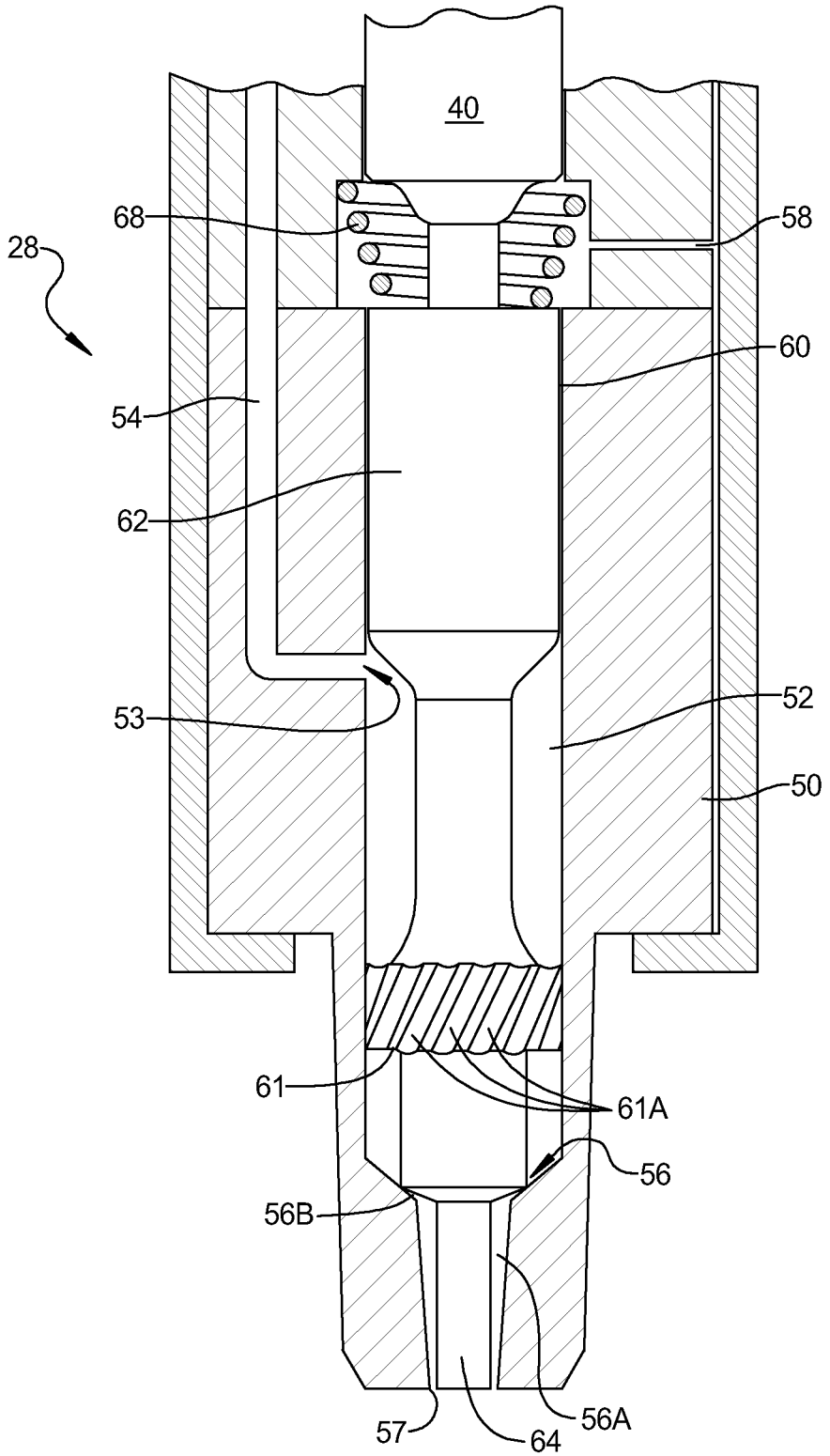
FIG. 2 is a partial section view of a fuel injector of the engine assembly of FIG. 1.

Referring to FIG. 1, an exemplary engine assembly 10 is schematically illustrated. The engine assembly 10 may include an engine 12 in communication with a fuel system 14 and a control module 16. In the example shown, the engine 12 may include an engine block 18 that defines a plurality of cylinders 20 in communication with the fuel system 14. While the engine 12 is illustrated as a four cylinder engine in the present disclosure it is understood that the present teachings apply to a variety of engine configurations and is in no way limited to the configuration shown.

The fuel system 14 may include a fuel pump 22, a fuel tank 24, a fuel rail 26, fuel injectors 28, a main fuel supply line 30, secondary fuel supply lines 32 and fuel return lines 34. The fuel pump 22 may be in communication with the fuel tank 24 and may provide a pressurized fuel supply to the fuel rail 26 via the main fuel supply line 30. The fuel rail 26 may provide the pressurized fuel to injectors 28 via the secondary fuel supply lines 32. The fuel rail 26 may include a pressure regulating valve 36 that regulates fuel pressure within the fuel rail 26 by returning excess fuel to the fuel tank 24 via a return line 38.

The fuel injectors 28 may each include an actuation assembly 40 in communication with the control module 16. In the present non-limiting example, the fuel injectors 28 may form direct injection fuel injectors where fuel is injected directly into the cylinders 20. The fuel injectors 28 may return excess fuel to the fuel tank 24 via the fuel return lines 34.

Referring to FIGS. 2-5, an exemplary fuel injector 28 according to the present disclosure is illustrated. The fuel injector 28 may include a housing 50. The housing 50 may define a longitudinal bore 52 and a high pressure fuel duct 54. The longitudinal bore 52 may be in communication with the high pressure fuel duct 54 at a fuel inlet port 53. Pressurized fuel may be provided to the longitudinal bore 52 of the fuel injector 28 through the high pressure fuel duct 54.

The housing 50 may further define a valve seat 56 and a nozzle 51. The valve seat 56 may include an aperture 56A and a valve seat surface 56B. The valve seat surface 56B may be in communication with the longitudinal bore 52 and high pressure fuel duct 54. The aperture 56A may extend through the valve seat surface 56B and be in communication with the longitudinal bore 52. The nozzle 51 may extend from the valve seat 56 to a nozzle outlet 57 and be in communication with the valve seat 56 and the longitudinal bore 52.

Fuel injector 28 may include a pintle nozzle assembly 60 disposed within the longitudinal bore 52. The pintle nozzle assembly 60 may include a stem 62 and a pintle 64. The stem 64 may be disposed within the longitudinal bore 52 and the pintle 64 may be disposed within the nozzle 51. In a first position of the pintle nozzle assembly 60, i.e., the closed position, the pintle nozzle assembly 60 may abut the valve seat 56 to seal the aperture 56A. In a second position of the pintle nozzle assembly 60, i.e., the fully opened position, the pintle nozzle assembly 60 may open the aperture 56A to the maximum extent allowed to spray pressurized fuel into the cylinder 20 in which the fuel injector 28 is inserted. The pintle nozzle assembly 60 may be variably displaceable such that the pintle nozzle assembly 60 may be moved to a plurality of positions between the first (closed) position and the second (fully opened) position. In this manner, the pintle nozzle assembly 60 may vary the size of the nozzle opening 55, which provides a variable amount of fuel and/or fuel flow rate to the cylinder 20.

The pintle nozzle assembly 60 may further include a biasing member 68. The biasing member 68 may interact with the pintle nozzle assembly 60, e.g., stem 62, to bias the pintle nozzle assembly 60 to be in the first (closed) position. The biasing member 68 may thus assist the pintle nozzle assembly 60 to seal the aperture 56A. The biasing member 68 may be a compression spring or similar device.

The pintle nozzle assembly 60 may be moved between the first (closed) position and the second (fully opened) position by an actuation assembly 40 coupled thereto. The actuation assembly 40 may be any variable position actuator, for example, a piezoelectric actuator, an electromagnetic actuator, a magnetostrictive actuator, a servo actuator or a solenoid actuator. In a non-limiting example, the actuation assembly 40 is coupled to the stem 62 and operates to move the pintle nozzle assembly 60 between the first (closed) position and second (fully opened) position. As discussed above, the actuation assembly 40 may operate to move the pintle nozzle assembly 60 to a plurality of positions between the first (closed) position and the second (fully opened) position such that the size of the nozzle opening 55 will vary, thus providing a variable amount of fuel and/or fuel flow rate to the cylinder 20.

The housing 50 may further define a low pressure fuel duct 58. The low pressure fuel duct 58 may be in communication within the longitudinal bore 52. During operation of the fuel injector 28, pressurized fuel may travel around the stem 62 from the high pressure fuel duct 54 to the low pressure fuel duct 58. The low pressure fuel duct 58 may be in communication with the fuel return lines 34 such that excess fuel may be returned to the fuel tank 24, as discussed above. The clearance between the stem 62 and the walls of the longitudinal bore 52 may be set as small as practicable to minimize fuel flow between the high pressure fuel duct 54 to the low pressure fuel duct 58. In a non-limiting example, the clearance between the stem 62 and the walls of the longitudinal bore 52 may be set between 0.1 and 4.0 microns, however this clearance may be adjusted for the application and execution of a specific design.

In a non-limiting example, the stem 62 may include a guide member 61 that assists in maintaining the pintle nozzle assembly 60 centered within the longitudinal bore 52 of the housing 50. For example only, referring to FIG. 2, the guide member 61 may comprise a cylindrical shaped body that contacts the walls of the longitudinal bore 52. The guide member 61 may include a plurality of grooves 61A that allow pressurized fuel to flow from the high pressure fuel duct 54 to the valve seat 56. The grooves 61A may be spiral grooves, longitudinal grooves, diagonal grooves or grooves having any other shape and/or orientation. The clearance between the guide member 61 and the walls of the longitudinal bore 52 may be set as small as practicable, e.g., between 0.1 and 4.0 microns, in order to maintain concentricity of the pintle 64 and the aperture 56A.

Referring to FIGS. 3-5, an exemplary fuel injector 28 according to the present disclosure is illustrated. In FIG. 3, the pintle nozzle assembly 60 is in the first (closed) position. In FIG. 4, the pintle nozzle assembly 60 is in the second (fully opened) position. In FIG. 5, the pintle nozzle assembly 60 is in a position between the first (closed) position and the second (fully opened) position.

In the non-limiting example illustrated in FIGS. 3-5, the pintle 64 may have a substantially constant diameter (pintle diameter D) and/or substantially constant cross-sectional area along the pintle length L, i.e., the pintle 64 is untapered. The nozzle 51 may be tapered such that nozzle diameter D' and/or the cross-sectional area of the nozzle varies along the nozzle length L'. In this manner, the area of the opening (nozzle opening 55) between the pintle 64 and the wall of the nozzle 51 (nozzle wall) may vary along the nozzle length L'. In this manner, the area of the nozzle opening 55 may increase as the lift S of the pintle nozzle assembly 60 increases.

The valve seat 56 may have a seat angle Θ between ninety degrees and one hundred and eighty degrees to provide a large valve opening 65 with a relatively small amount of lift S. Smaller seat angles Θ (such as, forty degrees to ninety degrees) may also be used if, for example, it is desirable to have a lower injection pressure associated with a relatively small amount of lift S.

Referring to FIG. 6, an alternate fuel injector 128 according to the present disclosure is illustrated. The fuel injector 128 may be similar to the fuel injector 28 with the exceptions noted below. Fuel injector 128 may include a housing 150 and pintle nozzle assembly 160. The housing 150 may define a nozzle 151 with a nozzle outlet 157 and a valve seat 156. The pintle nozzle assembly 160 may include a stem 162 and pintle 164. In this non-limiting example, the pintle 164 may have a pintle length L providing for a recess R that forms a nozzle opening 155 when the pintle nozzle assembly 160 is in the first (closed) position. The nozzle 151 may be tapered (for example, nozzle diameter D' and/or the cross-sectional area of the nozzle 151 decreases from the valve seat 156 to the nozzle outlet 157) and the pintle 164 may be untapered (pintle diameter D and/or the cross-sectional area of the pintle 164 remains constant along pintle length L).

Figure 7:
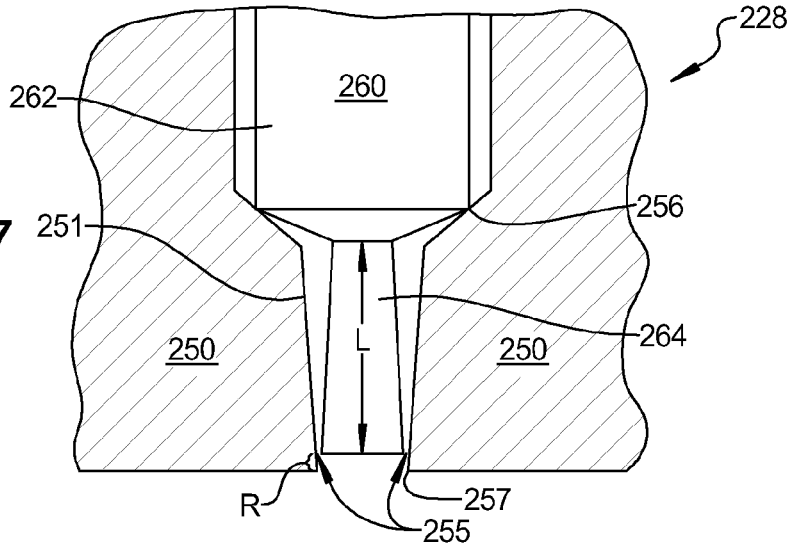
FIG. 7 is a partial section view of an exemplary fuel injector that may be utilized with the engine assembly of FIG. 1.

FIG. 7 illustrates a fuel injector 228 similar to the fuel injector 128 shown in FIG. 6 with the exceptions noted below. Fuel injector 228 may include a housing 250 and pintle nozzle assembly 260. The housing 250 may define a nozzle 251 with a nozzle outlet 257 and a valve seat 256. The pintle nozzle assembly 260 may include a stem 262 and pintle 264. The pintle 264 may have a pintle length L providing for a recess R that forms a nozzle opening 255 when the pintle nozzle assembly 260 is in the first (closed) position. In this non-limiting example, both the nozzle 251 and the pintle 264 may be tapered. By adjusting the tapering of one or both of the nozzle 151, 251 and pintle 164, 264, the area of the nozzle opening 155, 255 may be manipulated (such as, increase or stay constant) as the lift S of the pintle nozzle assembly 60 increases.

Figure 8:
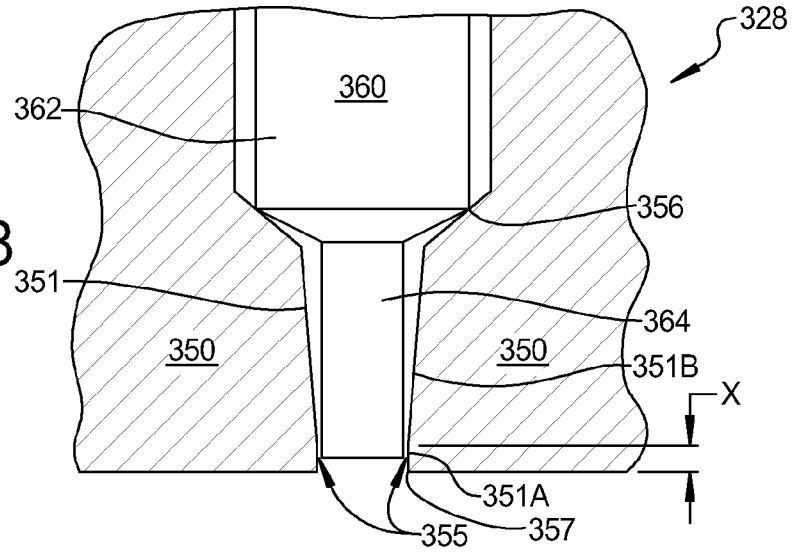
FIG. 8 is a partial section view of an exemplary fuel injector that may be utilized with the engine assembly of FIG. 1.

FIG. 8 illustrates a fuel injector 328 similar to fuel injectors 128, 228 described above, with the exceptions noted below. Fuel injector 328 may include a housing 350 and pintle nozzle assembly 360. The housing 350 may define a nozzle 351 with a nozzle outlet 357 and a valve seat 356. The pintle nozzle assembly 360 may include a stem 362 and pintle 364. A nozzle opening 355 may be present between the pintle 364 and the walls of the nozzle 351. In this non-limiting example, the nozzle 351 may include a first portion 351A and a second portion 351B. The first portion 351A may be untapered while the second portion 351B may be tapered. In this manner, the area of nozzle opening 355 may be constant for a lift S of the pintle nozzle assembly 360 less than or equal to the first portion length X. For a lift S greater than first portion length X, the area of nozzle opening 355 may increase with an increasing lift S, as described above.

Figure 9:
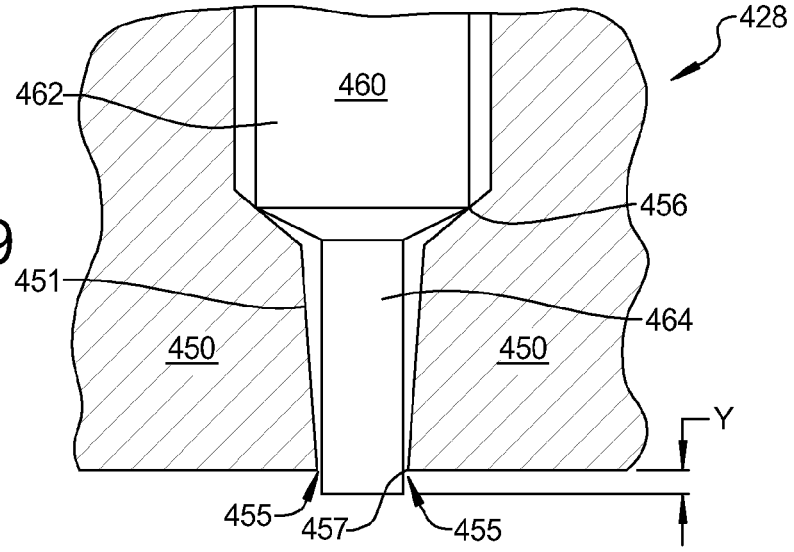
FIG. 9 is a partial section view of an exemplary fuel injector that may be utilized with the engine assembly of FIG. 1.

FIG. 9 illustrates a fuel injector 428 similar to fuel injectors 128, 228 described above, with the exceptions noted below. Fuel injector 428 may include a housing 450 and pintle nozzle assembly 460. The housing 450 may define a nozzle 451 with a nozzle outlet 457 and a valve seat 456. The pintle nozzle assembly 460 may include a stem 462 and pintle 464. A nozzle opening 455 may be present between the pintle 464 and the walls of the nozzle 451. In this non-limiting example, the nozzle 451 may be tapered, while the pintle 464 may be untapered and extend out of the nozzle outlet 457 by a length Y in the first (closed) position. In this manner, the area of nozzle opening 455 may be constant for a lift S of the pintle nozzle assembly 460 less than or equal to the length Y. For a lift S greater than length Y, the area of nozzle opening 455 may increase with an increasing lift S, as described above.

What is claimed is:

1. A fuel injector comprising:

a housing defining a longitudinal bore, a high pressure fuel duct in communication with the longitudinal bore and a valve seat including a valve seat surface and an aperture, the valve seat surface being in communication with the high pressure fuel duct and the aperture extending through the valve seat surface and being in communication with the longitudinal bore, the housing further defines a nozzle having a nozzle wall and a nozzle outlet, the nozzle extends between the valve seat and the nozzle outlet and an entirety of the nozzle continuously tapers inwardly from the aperture of the valve seat to the nozzle outlet;

a pintle nozzle assembly including a stem and a pintle, the pintle defining a terminal end of the entire pintle nozzle assembly, the pintle nozzle assembly being at least partially disposed within the longitudinal bore and being variably displaceable between a first position and a second position, the pintle nozzle assembly abutting the valve seat in the first position to seal the aperture, the pintle nozzle assembly being displaced from the valve seat in the second position to open the aperture, the pintle being disposed within the nozzle and having a constant diameter dimension along an entire length thereof from a proximal end adjacent said stem to a distal end of the pintle where both the pintle and the entire pintle nozzle assembly terminate, wherein an area between the pintle and the nozzle wall varies along at least a portion of the length of the nozzle such that the area increases as the actuation assembly moves the pintle nozzle assembly between the first position and the second position; and an actuation assembly coupled with the pintle nozzle assembly, wherein the actuation assembly operates to move the pintle nozzle assembly to a plurality of positions between the first position and the second position.

2. The fuel injector of claim 1, wherein the pintle nozzle assembly further includes a biasing member to bias the pintle nozzle assembly to be in the first position.

3. The fuel injector of claim 1, wherein the actuation assembly includes at least one of a piezoelectric actuator, an electromagnetic actuator, a magnetostrictive actuator, a servo actuator and a solenoid actuator.

4. The fuel injector of claim 1, wherein the stem includes at least one guide member that assists in maintaining the pintle nozzle assembly centered within the longitudinal bore.

5. The fuel injector of claim 1, wherein the valve seat defines a seat angle between ninety degrees and one hundred and eighty degrees.

6. The fuel injector of claim 1, wherein the valve seat defines a seat angle between forty degrees and ninety degrees.

7. A fuel injector comprising:

a housing defining a longitudinal bore, a high pressure fuel duct in communication with the longitudinal bore and a valve seat including a valve seat surface and an aperture, the valve seat surface being in communication with the high pressure fuel duct and the aperture extending through the valve seat surface and being in communication with the longitudinal bore, the housing further defines a nozzle having a nozzle wall and a nozzle outlet, the nozzle extends between the valve seat and the nozzle outlet and an entirety of the nozzle continuously tapers radially inward from the aperture of the valve seat to the nozzle outlet;

a pintle nozzle assembly including a stem and a pintle, the pintle defining a terminal end of the entire pintle nozzle assembly, the pintle nozzle assembly being at least partially disposed within the longitudinal bore and being variably displaceable between a first position and a second position, the stem of the pintle nozzle assembly including a stem seat abutting the valve seat in the first position to seal the aperture while the entire pintle remains recessed within the nozzle outlet, the stem seat of the pintle nozzle assembly being displaced from the valve seat in the second position to open the aperture, the pintle being disposed within the nozzle, wherein an area between the pintle and the nozzle wall varies along at least a portion of the length of the nozzle such that the area increases as the actuation assembly moves the pintle nozzle assembly between the first position and the second position; and an actuation assembly coupled with the pintle nozzle assembly, wherein the actuation assembly operates to move the pintle nozzle assembly to a plurality of positions between the first position and the second position;

wherein the entire pintle is tapered radially outward from a proximal end adjacent said stem seat toward a distal end disposed in said nozzle outlet such that the area between the pintle and the nozzle wall varies along the nozzle length.

8. An engine assembly comprising:

an engine structure defining a cylinder; and a fuel injector supported by the engine structure and in communication with the cylinder, the fuel injector including:

a housing defining a longitudinal bore, a high pressure fuel duct in communication with the longitudinal bore and a valve seat including a valve seat surface and an aperture, the valve seat surface being in communication with the high pressure fuel duct and the aperture extending through the valve seat surface and being in communication with the longitudinal bore, the housing further defines a nozzle having a nozzle wall and a nozzle outlet, the nozzle extends between the valve seat and the nozzle outlet and an entirety of the nozzle continuously tapers radially inward from the aperture of the valve seat to the nozzle outlet;

a pintle nozzle assembly including a stem and a pintle, the pintle defining a terminal end of the entire pintle nozzle assembly, the pintle nozzle assembly being at least partially disposed within the longitudinal bore and being variably displaceable between a first position and a second position, the pintle nozzle assembly abutting the valve seat in the first position to seal the aperture, the pintle nozzle assembly being displaced from the valve seat in the second position to open the aperture, the pintle being disposed within the nozzle and having a constant diameter dimension along an entire length thereof from a proximal end adjacent said stem to a distal end of the pintle where both the pintle and the pintle nozzle assembly terminate, wherein an area between the pintle and the nozzle wall varies along at least a portion of the length of the nozzle such that the area increases as the actuation assembly moves the pintle nozzle assembly between the first position and the second position; and an actuation assembly coupled with the pintle nozzle assembly, wherein the actuation assembly operates to move the pintle nozzle assembly to a plurality of positions between the first position and the second position.

9. The engine assembly of claim 8, wherein the pintle nozzle assembly further includes a biasing member to bias the pintle nozzle assembly to be in the first position.

10. The engine assembly of claim 8, wherein the actuation assembly includes at least one of a piezoelectric actuator, an electromagnetic actuator, a magnetostrictive actuator, a servo actuator and a solenoid actuator.

11. The engine assembly of claim 8, wherein the stem includes at least one guide member that assists in maintaining the pintle nozzle assembly centered within the longitudinal bore.

12. The engine assembly of claim 8, wherein the valve seat defines a seat angle between ninety degrees and one hundred and eighty degrees.

13. The engine assembly of claim 8, wherein the valve seat defines a seat angle between forty degrees and ninety degrees.

* * * * *